US008685605B2

(12) United States Patent
Sacripante et al.

(10) Patent No.: US 8,685,605 B2
(45) Date of Patent: Apr. 1, 2014

(54) LOW MELT TONER

(75) Inventors: Guerino Sacripante, Oakville (CA); Ke Zhou, Oakville (CA); Jordan Wosnick, Toronto (CA); Edward Zwartz, Mississauga (CA); Michael Hawkins, Cambridge (CA)

(73) Assignee: Xerox Corportion, Norwalk, CT (US)

( * ) Notice: Subject to any disclaimer, the term of this patent is extended or adjusted under 35 U.S.C. 154(b) by 7 days.

(21) Appl. No.: 13/444,835

(22) Filed: Apr. 11, 2012

(65) Prior Publication Data

US 2013/0273471 A1 Oct. 17, 2013

(51) Int. Cl.
*G03G 9/093* (2006.01)

(52) U.S. Cl.
USPC ..... 430/110.1; 430/109.1; 430/109.31; 430/110.2

(58) Field of Classification Search
USPC ..... 430/109.1–109.31, 110.1, 110.2
See application file for complete search history.

(56) References Cited

U.S. PATENT DOCUMENTS

| | | | | |
|---|---|---|---|---|
| 6,245,863 | B1 * | 6/2001 | Al Ghatta | 525/437 |
| 2005/0277043 | A1 * | 12/2005 | Tanma et al. | 430/109.3 |
| 2008/0153027 | A1 | 6/2008 | Veregin | |
| 2009/0053644 | A1 * | 2/2009 | Sacripante | 430/137.13 |
| 2010/0233605 | A1 * | 9/2010 | Iida et al. | 430/105 |
| 2011/0104608 | A1 * | 5/2011 | Nakajima et al. | 430/109.31 |
| 2011/0151368 | A1 * | 6/2011 | Hong et al. | 430/108.8 |
| 2011/0244383 | A1 * | 10/2011 | Yamamoto et al. | 430/105 |
| 2012/0196218 | A1 * | 8/2012 | Hong et al. | 430/105 |

* cited by examiner

*Primary Examiner* — Mark F Huff
*Assistant Examiner* — Rashid Alam
(74) *Attorney, Agent, or Firm* — MDIP LLC

(57) ABSTRACT

Toners containing encapsulated crystalline resin have lower minimum fix temperatures without charge degradation.

19 Claims, No Drawings

LOW MELT TONER

TECHNICAL FIELD

The present disclosure relates to toners containing increasing concentrations of crystalline resins. The toners comprise encapsulated nano-sized resin particles having a core-shell morphology with a crystalline resin in the core, and have reduced minimum fix temperature, good charge or both.

BACKGROUND

Emulsion aggregation (EA) toners are used in forming print and/or electrophotographic images. Emulsion aggregation techniques may involve the formation of a polymer emulsion by heating a monomer and undertaking a batch or semi-continuous emulsion polymerization, as disclosed in, for example, U.S. Pat. Nos. 5,853,943, 5,290,654, 5,278,020, 5,308,734, 5,344,738, 6,593,049, 6,743,559, 6,756,176, 6,830,860, 7,029,817 and 7,329,476, and U.S. Publ. Nos. 2006/0216626, 2008/0107989, 2008/0107990, 2008/0236446 and 2009/0047593. The disclosure of each of the foregoing documents hereby is incorporated by reference in entirety.

Polyester EA ultra low melt (ULM) toners are prepared utilizing amorphous and crystalline polyester resins as illustrated, for example, in U.S. Publ. No. 2008/0153027, the disclosure of which is hereby incorporated by reference in entirety.

Current ULM polyester-based toners result in a minimum fusing temperature (MFT) reduction of about 20° C. as compared to that of standard toners, and that enables lower fuser energy, which translates to increased device longevity. The reduction of MFT is achieved by the introduction of a crystalline resin in amounts from about 5 to about 10%. Although adding more crystalline resin (about 10 to about 20%) reduces the MFT further, the crystalline properties, i.e., conductivity, degrade electrical performance.

Thus, reduction of the MFT of toners without degradation of the electrical performance of toners remains desirable.

SUMMARY

The present disclosure comprises an emulsion of nano-sized core crystalline resin-shell amorphous resin particles, that are mixed with other reagents to produce toner particles, which, for example, have reduced minimum fixing temperature (MFT) without sacrificing the electrical performance of the toner.

In embodiments, a toner is disclosed comprising an emulsion comprising a nanoparticle comprising a core and a shell, where the core comprises a crystalline resin and the nanoparticle shell comprises a first amorphous resin, where the acid value of the core crystalline resin is lower than the acid value of the first amorphous resin of the nanoparticle shell. That nanoparticle is mixed with at least one second amorphous resin; an optional pigment; and an optional wax to form a toner particle. The toner particle can comprise a shell.

In embodiments, a toner is disclosed comprising a nanoparticle comprising a core and a shell, where the core comprises a crystalline resin and the shell comprises a first amorphous resin, and where the crystalline resin has an acid value of less than about 1 meq KOH/g and the first amorphous resin of the nanoparticle shell has an acid value of greater than about 10 meq KOH/g. The nanoparticle can be combined with one or more second amorphous resins and optionally a pigment and a wax to form a toner particle. The toner particle can comprise a shell thereon or thereover, where the shell can comprise at least a third amorphous resin. The toner can have a minimum fixing temperature of from about 100° C. to about 130° C., and a fusing latitude of about 60° C. or greater, such as, when the toner comprises at least 10% by weight of crystalline resin.

In embodiments, the nanoparticle comprising a crystalline resin has a particle size of between about 50 to about 250 nm. The nanoparticle can be used in an aggregation/emulsion process for making toner. Any one or more second amorphous resins and any toner particle shell serve to contain the crystalline resin within the toner particle so as to insulate the nanoparticle and the crystalline resin therein from the toner particle surface.

DETAILED DESCRIPTION

Currently, ultra low melt (ULM) polyester-based toners result in a benchmark minimum fix temperature (MFT), synonymous with minimum fusing temperature, which is reduced by about 20° C. as compared to previous EA toners that have an MFT generally greater than about 135° C. The reduction in MFT may be achieved by introducing a crystalline component (for, example, about 5 to 10%) in the toner. Although adding more crystalline resin (for example, about 10-20%) reduces the MFT further (e.g., by about 30° C. or more; i.e., super low melt (SLM) toner), the crystalline properties of the resin can degrade toner electrical performance (e.g., conductivity), especially with respect to charge maintenance.

While not being bound by theory, the poor A-zone charge and charge maintainability of ULM toners containing crystalline and amorphous resins may be due to the low resistivity crystalline component migrating to the toner surface. Even though a toner particle shell containing, for example, an amorphous resin, may be added subsequently, the EA process does not always avoid diffusion of the crystalline resin to the toner particle surface. If the crystalline component is encapsulated/sequestered prior to aggregation and coalescence, the diffusion thereof to the surface can be avoided. As disclosed herein, in embodiments, toner charge is substantially the same for toner carrying increasing amounts of crystalline resin as for toners comprising nominal crystalline resin loading (e.g., 6.8% CPE) when the crystalline component is encapsulated or sequestered in or by a shell of, for example, an amorphous resin, to form a nanoparticle. The nanoparticle is mixed with other reagents, such as, an amorphous resin, to form a toner particle. In embodiments, that toner particle further can comprise a shell to form yet another encasing barrier to minimize movement and presence of the crystalline resin at, near or to the toner particle surface.

The present disclosure provides the use of nano-sized resin particles comprised of a core-shell morphology, where the core comprises a crystalline resin and the shell comprises a first amorphous resin. In embodiments, the nanoparticle is included in a toner particle that comprises a second amorphous resin, and an optional third amorphous resin, such as, in a toner particle shell, and both second and third resins can be partially or fully compatible with the crystalline resin during fusing.

In embodiments, the nanoparticle core comprises a crystalline resin comprising a low acid value (i.e., <about 1 meq KOH/g, <about 1.5 meq KOH/g, <about 2 meq KOH/g), and the nanoparticle shell comprises a first amorphous resin comprising an acid value higher than that of the core crystalline resin (e.g., >about 1 meq KOH/g, >about 5 meq KOH/g, >about 10 meq KOH/g). The nanoparticles may be made by phase inversion emulsification (PIE) or solvent flash techniques, for example. Again, while not being bound by theory, as the amorphous resin has the higher acid value, a core-shell morphology is generated in an aqueous medium where the core comprises the crystalline component and the shell comprises the amorphous component.

The core-shell morphology of the nanoparticle comprises a core of a crystalline resin that is partially or completely encased or surrounded by a first amorphous resin. Hence, a nanoparticle of interest can present with a crystalline resin comprising islands or patches of the first amorphous resin thereon or thereover, up through where the crystalline resin is completely covered by or encased with the first amorphous resin forming a contiguous and intact shell, enveloping the crystalline resin.

In embodiments, the nanoparticles may range in size from about 50 nm to about 250 nm, from about 75 nm to about 225 nm, about 100 nm to about 200 nm, from about 125 nm to about 175 nm. In embodiments, once a selected nanoparticle size is achieved, the nanoparticles may be used as a reagent for preparing toner, and hence, combined with, in embodiments, one or more second amorphous resins, such as a high molecular weight (MW) amorphous resin and a low MW amorphous resin, to make a toner particle, for example, via the EA process, where similar or different amorphous resins (a third amorphous resin) can be added to form a shell over the toner particle, for example, in a secondary delayed addition step to further insulate the crystalline resin in the nanoparticles from the toner particle surface.

The second and third amorphous resins, for example, may be incompatible with the first amorphous resin forming the nanoparticle. Further, during fusing, the second and third resins may be compatible with the core crystalline resin so that ULM properties are attained. Incompatibility refers to plural substances that form independent phases and do not mix with each other.

ULM or SLM toners, as used herein, in embodiments, include toners with a reduction in MFT of about 20° C. to about 40° C. as compared to prior EA toners. In embodiments, an ULM or SLM toner of the present disclosure may have an MFT of from about 100° C. to about 130° C., in embodiments, from about 105° C. to about 125° C., in embodiments, from about 110° C. to about 120° C. In embodiments, the fusing latitude of a toner of interest, with a crystalline resin content, on a weight basis, of about 10% of the toner is at least about 60° C., at least about 62.5° C., at least about 65° C., at least about 67.5° C.

In embodiments, an advantage of having an encapsulated/sequestered crystalline resin in a nanoparticle is to minimize or to avoid poor electrical performance (tribo) that is influenced by the low resistivity of the crystalline component, which may appear at or near the particle surface of a toner particle that is free of or does not comprise a crystalline resin encased in a nanoparticle of interest. In embodiments, during EA toner preparation, the coalescence temperature may be above the $T_g$ of the amorphous resins, but below the melting point of the crystalline polyester resin. In embodiments, different types of amorphous resins for the second, third emulsion resins may be used, having varying properties, such as, molecular weight, to control, for example, hot offset.

Resins

In embodiments, any suitable resin for forming a toner can be used herein, including polyester resins, which will be the focus of the following discussion. Suitable polyester resins include, for example, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosure of each of which hereby is incorporated by reference in entirety. Suitable resins include a mixture of an amorphous polyester resin and a crystalline polyester resin as described in U.S. Pat. No. 6,830,860, the disclosure of which is hereby incorporated by reference in entirety.

Crystalline Resins

In embodiments, the crystalline resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol may be, for example, selected in an amount of from about 40 to about 60 mole %, in embodiments, from about 42 to about 55 mole %, in embodiments, from about 45 to about 53 mole % (although amounts outside of those ranges may be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, and a diester or anhydride thereof. The organic diacid may be selected in an amount of, for example, in embodiments from about 40 to about 60 mole %, in embodiments, from about 42 to about 52 mole %, in embodiments from about 45 to about 50 mole %.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) and so on. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly (hexylene-adipimide), poly(octylene-adipimide), poly(ethylene-succinimide), poly(propylene-succinimide), and poly (butylene-succinimide).

Suitable crystalline resins include those disclosed in U.S. Publ. No. 2006/0222991, the disclosure of which is hereby incorporated by reference in entirety. In embodiments, a suitable crystalline resin may be composed of ethylene glycol and a mixture of dodecanedioic acid and fumaric acid comonomers.

The crystalline resin may be present, for example, in an amount of from about 5 to about 50% by weight of the toner components, in embodiments, from about 7 to about 40% by weight of the toner components, in embodiments, from about 10 to about 35% by weight of the toner components. In embodiments, the crystalline resin can comprise at least about 7.5% of the toner particle weight, at least about 10%, at least about 12.5%, or more. The crystalline resin may possess various melting points of, for example, from about 30° C. to about 120° C., in embodiments, from about 50° C. to about 90° C. The crystalline resin may have a number average molecular weight ($M_n$) as measured by gel permeation chromatography (GPC) of, for example, from about 1,000 to about 50,000, in embodiments, from about 2,000 to about 25,000, and a weight average molecular weight ($M_w$) of, for example, from about 2,000 to about 100,000, in embodiments, from about 3,000 to about 80,000, as determined by GPC. The molecular weight distribution ($M_w/M_n$) of the crystalline resin may be, for example, from about 2 to about 6, in embodiments, from about 3 to about 4. The crystalline polyester resins may have an acid value of less than about 1 meq KOH/g, from about 0.5 to about 0.65 meq KOH/g, in embodiments, from about 0.65 to about 0.75 meq KOH/g, from about 0.75 to about 0.8 meq KOH/g.

In embodiments, a process is disclosed including forming a crystalline resin including combining a diacid or diester, at least two diols and a polycondensation catalyst, heating the mixture and reducing pressure over the mixture until a viscosity of about 4600 centipoises is achieved, where the resulting crystalline resin has an acid value of less than about 1 meq KOH/g.

Catalyst

Polycondensation catalysts which may be utilized in forming either the crystalline or amorphous polyesters include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole %, based on the starting diacid or diester used to generate the polyester resin.

Amorphous Resins

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole % of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, 1,2-ethanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like, and mixtures thereof. The amount of organic diol selected may vary, and more specifically, is, for example, from about 45 to about 52 mole % of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 wt % of the resin may be selected.

Exemplary amorphous polyester resins include, but are not limited to, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and combinations thereof.

In embodiments, a suitable amorphous polyester resin may be a poly(propoxylated bisphenol A co-fumarate) resin. Examples of such resins and processes for their production include those disclosed in U.S. Pat. No. 6,063,827, the disclosure of which is hereby incorporated by reference in entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A polyester based resins that may be utilized and are commercially available include XP767, FXC-42 and FXC-56 from Kao Corporation, Japan, and XP777 from Reichhold, Research Triangle Park, N.C., and the like.

In embodiments, a suitable amorphous resin utilized in a toner of the present disclosure may be a low molecular weight amorphous resin, sometimes referred to, in embodiments, as an oligomer, having an $M_w$ of from about 500 daltons to about 10,000 daltons, in embodiments, from about 1000 daltons to about 5000 daltons, in embodiments, from about 1500 daltons to about 4000 daltons. The amorphous resin may possess a $T_g$ of from about 58.5° C. to about 66° C., in embodiments, from about 60° C. to about 62° C. The low molecular weight amorphous resin may possess a softening point of from about 105° C. to about 118° C., in embodiments, from about 107° C. to about 109° C. The amorphous polyester resins may have an acid value of from about 8 to about 20 meq KOH/g, in embodiments, from about 10 to about 16 meq KOH/g, in embodiments, from about 11 to about 15 meq KOH/g.

In other embodiments, an amorphous resin utilized in forming a toner of the present disclosure may be a high molecular weight amorphous resin. As used herein, the high molecular weight amorphous polyester resin may have, for example, an $M_n$, as measured by GPC of, for example, from about 1,000 to about 10,000, in embodiments, from about 2,000 to about 9,000, in embodiments, from about 3,000 to about 8,000, in embodiments from about 6,000 to about 7,000. The $M_w$ of the resin can be greater than 45,000, for example, from about 45,000 to about 150,000, in embodiments, from about 50,000 to about 100,000, in embodiments, from about 63,000 to about 94,000, in embodiments, from about 68,000 to about 85,000, as determined by GPC. The polydispersity index (PD), equivalent to the molecular weight distribution, is above about 4, such as, for example, in embodiments, from about 4 to about 20, in embodiments, from about 5 to about 10, in embodiments, from about 6 to about 8, as measured by GPC. The high molecular weight amorphous polyester resins, which are available from a number of sources, may possess various melting points of, for example, from about 30° C. to about 140° C., in embodiments, from about 75° C. to about 130° C., in embodiments, from about 100° C. to about 125° C., in embodiments, from about 115° C. to about 124° C. High molecular weight amorphous resins may possess a $T_g$ of from about 53° C. to about 58° C., in embodiments, from about 54.5° C. to about 57° C.

The amorphous resin(s) is generally present in the toner composition in various suitable amounts, such as from about 50 to about 90 wt %, in embodiments, from about 60 to about 85 wt %.

In further embodiments, the combined amorphous resins may have a melt viscosity of from about 10 to about 1,000,000 Pa*S at about 130° C., in embodiments, from about 50 to about 100,000 Pa*S.

Branching Agents

Branching agents may be used in forming branched polyesters include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole % of the resin. The amorphous polyester resin may be a branched resin. As used herein, the terms "branched" or "branching" includes branched resins and/or cross-linked resins.

Crosslinking

Linear or branched unsaturated polyesters selected for reactions include both saturated and unsaturated diacids (or anhydrides) and dihydric alcohols (glycols or diols). The resulting unsaturated polyesters can be reactive (for example, crosslinkable) on two fronts: (i) unsaturation sites (double bonds) along the polyester chain, and (ii) functional groups, such as, carboxyl, hydroxy and similar groups amenable to acid-base reaction. Unsaturated polyester resins may be prepared by melt polycondensation or other polymerization processes using diacids and/or anhydrides and diols. Illustrative examples of unsaturated polyesters may include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation), XP777 (Reichhold Inc.), mixtures thereof and the like. The resins may also be functionalized, such as, carboxylated, sulfonated or the like, such as, sodio sulfonated.

As noted above, in embodiments, the resin may be formed by emulsion polymerization methods. Utilizing such methods, the resin may be present in a resin emulsion, which may then be combined with other components and additives to form a toner of the present disclosure.

Compatibility of crystalline and amorphous resins may be determined by melt mixing the resins over a specific period of time (e.g., about 30 min, about 45 min, about 60 min and the like) at a suitable temperature (e.g., about 130° C.) followed by cooling and characterization via, for example, differential scanning calorimetry (DSC). Typically, a crystalline resin displays a melt peak at about 50°-60° C., whereas amorphous resins display a $T_g$ at about 50-60° C. With incompatible resins, both the corresponding $T_g$ and melting point of the mixtures remain unaffected. If the resins are fully compatible, the $T_g$ is depressed and no melting point is observed. For partial compatibility, the $T_g$ is depressed in a graded amount and the melting point is decreased. To measure the extent of compatibility, the enthalpy of crystallization may be measured. For full compatibility a value of less than about 0.1 mJ, less than about 0.2 mJ, less than about 0.3 mJ may be observed, whereas for full incompatibility, a value of greater than 2.0 mJ, greater than 3.0 mJ, greater than 4.0 mJ, greater than 5.0 mJ may be observed via DSC.

Colorants

In embodiments, colorants may be added to the resin mixture to adjust or to change the color of the resulting toner. In embodiments, colorants utilized to form toner compositions may be in dispersions. As the colorant to be added, various known suitable colorants, such as dyes, pigments, mixtures of dyes, mixtures of pigments, mixtures of dyes and pigments, and the like, may be included in the toner. The colorant may be added in amounts from about 0.1 to about 35 wt % of the toner, in embodiments, from about 1 to about 15 wt % of the toner, in embodiments, from about 3 to about 10 wt % of the toner.

As examples of suitable colorants, mention may be made of $TiO_2$; carbon black like REGAL 330® and NIPEX® 35; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB- 100™, or TMB-104™; and the like. As colored pigments, there may be selected cyan, magenta, yellow, orange, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that may be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Pigment Blue 15:4 and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants may be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like. Other pigments that are available from various suppliers include various pigments in the following classes identified as Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7, combinations thereof, and the like.

In embodiments, the colorant may include a pigment, a dye, combinations thereof, carbon black, magnetite, black, cyan, magenta, yellow, red, green, blue, brown, as well as combinations thereof, in an amount sufficient to impart the desired color to the toner.

Solvent

Solvents may be added in the formation of the latexes to permit the necessary reorientation of chain ends to stabilize and to form particles which lead to the formation of stable latexes without surfactant. In embodiments, solvents sometimes referred to, as phase inversion agents, may be used to form the latex. These solvents may include, for example, acetone, toluene, tetrahydrofuran, methyl ethyl ketone, dichloromethane, combinations thereof and the like.

In embodiments, the solvents may be utilized in an amount of, for example, from about 1 weight percent to about 25 weight percent of the resin, in embodiments, from about 2 weight percent to about 20 weight percent of the resin, in embodiments, from about 3 weight percent to about 15 weight percent of the resin.

In embodiments, an emulsion formed in accordance with the present disclosure may also include water, in embodiments, de-ionized water (DIW), in amounts from about 30% to about 95%, in embodiments, from about 35% to about 60%, at temperatures that melt or soften the resin, from about 20° C. to about 120° C., in embodiments, from about 30° C. to about 100° C.

The particle size of the emulsion may be from about 50 nm to about 300 nm, in embodiments, from about 100 nm to about 220 nm.

Surfactants

In embodiments, a surfactant may be added to the resin, and to an optional colorant to form emulsions.

Where utilized, a resin emulsion may include one, two, or more surfactants. The surfactants may be selected from ionic surfactants and nonionic surfactants. Anionic surfactants and cationic surfactants are encompassed by the term, "ionic surfactants." In embodiments, the surfactant may be added as a solid or as a solution with a concentration from about 5% to about 100% (pure surfactant) by weight, in embodiments, from about 10% to about 95 wt %. In embodiments, the surfactant may be utilized so that it is present in an amount from about 0.01 wt % to about 20 wt % of the resin, in embodiments, from about 0.1 wt % to about 16 wt % of the resin, in embodiments, from about 1 wt % to about 14 wt % of the resin.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™™ 2A1, an alkyldiphenyloxide disulfonate from The Dow Chemical Company, and/or TAYCA POWER BN2060 from Tayca Corporation (Japan), which are branched sodium dodecylbenzene sulfonates.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUATT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC PE/F, in embodiments SYNPERONIC PE/F 108.

Combinations of the surfactants may be utilized in embodiments.

Wax

Optionally, a wax may be combined with the resin in forming toner particles. The wax may be provided in a wax dispersion, which may include a single type of wax or a mixture of two or more different waxes. A single wax may be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes may be added to provide multiple properties to the toner composition.

When included, the wax may be present in an amount of, for example, from about 1 wt % to about 25 wt % of the toner particles, in embodiments, from about 5 wt % to about 20 wt % of the toner particles.

When a wax dispersion is used, the wax dispersion may include any of the various waxes conventionally used in emulsion aggregation toner compositions. Waxes that may be selected include waxes having, for example, an average molecular weight from about 500 to about 20,000, in embodiments, from about 1,000 to about 10,000. Waxes that may be used include, for example, polyolefins, such as, polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethylene glycol monostearate, dipropylene glycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be from about 100 nm to about 300 nm.

Coagulants

Optionally, a coagulant may be combined with the resin, optional colorant, and a wax in forming toner particles. Such coagulants may be incorporated into the toner particles during particle aggregation. The coagulant may be present in the toner particles, exclusive of external additives and on a dry weight basis, in an amount of, for example, from about 0.01 wt % to about 5 wt % of the toner particles, in embodiments, from about 0.01 wt % to about 3 wt % of the toner particles.

Coagulants that may be used include, for example, an ionic coagulant, such as a cationic coagulant. Inorganic cationic coagulants include metal salts, for example, aluminum sulfate, magnesium sulfate, zinc sulfate, potassium aluminum sulfate, calcium acetate, calcium chloride, calcium nitrate, zinc acetate, zinc nitrate, aluminum chloride, combinations thereof and the like.

Examples of organic cationic coagulants may include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$-trimethyl ammonium bromides, halide salts of quaternized polyoxyethylalkylamines, dodecylbenzyl triethyl ammonium chloride, combinations thereof and the like.

Other suitable coagulants may include, a monovalent metal coagulant, a divalent metal coagulant, a polyion coagulant, or the like. As used herein, "polyion coagulant" refers to a coagulant that is a salt or oxide, such as a metal salt or metal oxide, formed from a metal species having a valence of at least 3, in embodiments, at least 4 or 5. Suitable coagulants thus may include, for example, coagulants based on aluminum salts, such as aluminum sulfate and aluminum chlorides, polyaluminum halides such as polyaluminum fluoride and polyaluminum chloride (PAC), polyaluminum silicates such as polyaluminum sulfosilicate (PASS), polyaluminum hydroxide, polyaluminum phosphate, combinations thereof and the like.

Other suitable coagulants may also include, but are not limited to, tetraalkyl titanates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, combinations thereof, and the like. Where the coagulant is a polyion coagulant, the coagulants may have any desired number of polyion atoms present. For example, in embodiments, suitable polyaluminum compounds may have from about 2 to about 13, in embodiments, from about 3 to about 8, aluminum ions present in the compound.

Processing

The present process includes forming a mixture at an elevated temperature comprising a nanoparticle comprising a crystalline resin core and an amorphous resin shell, and combining that nanoparticle with at least one second amorphous resin, optionally a pigment, optionally a wax and optionally a surfactant, to form a latex emulsion for forming toner particles. Essentially any method for forming particles in emulsions, for forming particles and so on, as known in the toner art and as taught herein can be used to produced the nanoparticles of interest, the difference in acid value between the crystalline resin and the first amorphous resin facilitates formation of the core-shell morphology of the nanoparticle, with the crystalline resin forming the core.

Aside from the core-shell nanoparticle, one, two or more resins may be used. In embodiments, the resin may be an amorphous resin or a mixture of amorphous resins and the temperature may be above the $T_g$ of the mixture. In embodiments, where two or more resins are used, the resins may be in any suitable ratio (e.g., weight ratio) such as, for instance, of from about 1% (first resin)/99% (second resin) to about 99% (first resin)/1% (second resin), in embodiments, from about 4% (first resin)/96% (second resin) to about 96% (first resin)/4% (second resin).

Thus, in embodiments, a process of the present disclosure may include contacting the nanoparticle of interest with at least one second amorphous resin optionally with a surfactant to form a resin mixture, contacting the resin mixture with optionally a pigment, optional surfactant and water to form a phase inversed latex emulsion, distilling the latex to remove a water/solvent mixture in the distillate and producing a latex.

In the phase inversion process, the resins may be dissolved in a solvent as known, at a concentration from about 1 wt % to about 85 wt % resin in solvent, in embodiments, from about 5 wt % to about 60 wt % resin in solvent.

In embodiments, the resin may be preblended in the solvent to form a resin mixture.

The resin mixture may then be heated to a temperature of from about 25° C. to about 90° C., in embodiments, from about 30° C. to about 85° C. The temperature can be higher than the $T_g$ of the amorphous resins and is lower than the melting point of the crystalline resin. The heating need not be held at a constant temperature, but may be varied. For example, the heating may be slowly or incrementally increased until a desired temperature is achieved.

In embodiments, a pigment, optionally in a dispersion, may be mixed together with a neutralizing agent or base solution (such as sodium bicarbonate) and optional surfactant in deionized water (DIW) to form a phase inversion solution. The resin mixture may then be contacted with the phase inversion solution to form a neutralized solution. The phase inversion solution may be contacted with the resin mixture to neutralize acid end groups on the resin, and form a uniform dispersion of resin particles through phase inversion. The solvents remain in both the resin particles and water phase at this stage. Through vacuum distillation, for example, the solvents can be removed.

DIW may be added to form a latex emulsion with a solids content of from about 5% to about 50%, in embodiments, of from about 10% to about 45%. While higher water temperatures may accelerate the dissolution process, latexes may be formed at temperatures as low as room temperature (RT). In embodiments, water temperatures may be from about 40° C. to about 110° C., in embodiments, from about 50° C. to about 100° C.

In embodiments, a pigment and/or a surfactant may be added to the one or more ingredients of the resin composition before, during or after melt-mixing. In embodiments, a pigment and/or a surfactant may be added before, during or after the addition of the neutralizing agent. In embodiments, a pigment and/or surfactant may be added prior to the addition of the neutralizing agent. In embodiments, a pigment and/or a surfactant may be added to the pre-blend mixture prior to melt mixing.

In embodiments, a continuous phase inversed emulsion may be formed. Phase inversion may be accomplished by continuing to add an aqueous alkaline solution or basic agent, optional surfactant and/or water compositions to create a phase inversed emulsion which includes a disperse phase including droplets possessing the ingredients of the resin composition, and a continuous phase including the surfactant and/or water composition.

Melt mixing may be conducted, in embodiments, utilizing any means within the purview of those skilled in the art. For example, melt mixing may be conducted in a glass kettle with an anchor blade impeller, an extruder, i.e., a twin screw extruder, a kneader such as a Haake mixer, a batch reactor or any other device capable of intimately mixing viscous materials to create near homogenous mixtures.

Stirring, although not necessary, may be utilized to enhance formation of the latex. Any suitable stirring device may be utilized. In embodiments, the stirring may be at a speed from about 10 revolutions per minute (rpm) to about 5,000 rpm, in embodiments, from about 20 rpm to about 2,000 rpm, in embodiments, from about 50 rpm to about 1,000 rpm. The stirring need not be at a constant speed, but may be varied. For example, as the heating of the mixture becomes more uniform, the stirring rate may be increased. In embodiments, a homogenizer (that is, a high shear device), may be utilized to form the phase inversed emulsion. Where utilized, a homogenizer may operate at a rate from about 3,000 rpm to about 10,000 rpm.

Although the point of phase inversion may vary depending on the components of the emulsion, the temperature of heating, the stirring speed and the like, phase inversion may occur when the basic neutralization agent, optional surfactant, and/or water has been added so that the resulting resin is present in an amount from about 5 wt % to about 70 wt % of the emulsion, in embodiments, from about 20 wt % to about 65 wt % of the emulsion, in embodiments, from about 30 wt % to about 60 wt % of the emulsion.

Following phase inversion, additional surfactant, water, and/or aqueous alkaline solution optionally may be added to dilute the phase inversed emulsion, although not required.

Following phase inversion, the phase inversed emulsion may be cooled to room temperature, for example from about 20° C. to about 25° C.

The latex emulsions of the present disclosure may then be utilized to produce particles that are suitable for emulsion aggregation of super low melt toner.

The emulsified resin particles in the aqueous medium may have a submicron size, for example of about 1 μm or less, in embodiments, about 500 nm or less, such as, from about 10 nm to about 500 nm, in embodiments, from about 50 nm to about 400 nm, in embodiments, from about 100 nm to about 300 nm. A coarse particle is one greater is size than a particle of the ranges cited above. Adjustments in particle size may be made by modifying the ratio of water to resin, the neutralization ratio, solvent concentration and solvent composition.

The coarse content of the latex of the present disclosure may be from about 0.01 wt % to about 5 wt %, in embodiments, from about 0.1 wt % to about 3 wt %. The solids content of the latex of the present disclosure may be from about 5 wt % to about 50 wt %, in embodiments, from about 20 wt % to about 40 wt %.

In embodiments, the molecular weight of the resin emulsion particles of the present disclosure may be from about 18,000 grams/mole to about 26,000 grams/mole, in embodiments from about 21,500 grams/mole to about 25,000 grams/mole, in embodiments from about 23,000 grams/mole to about 24,000 grams/mole.

Once the resin mixture, has been contacted with an optional colorant and water to form an emulsion, and the solvent removed from this mixture as described above, the resulting latex may then be utilized to form a toner by any method within the purview of those skilled in the art. The latex emulsion may be contacted with an optional colorant, optionally in a dispersion, and other additives, to form a super low melt toner by a suitable process, in embodiments, an emulsion aggregation and coalescence process.

As provided herein, the crystalline resin and the first amorphous resin are selected to encourage formation of a core-shell nanoparticle, where the crystalline resin comprises the core and the amorphous resin comprises the shell. Because many emulsification reactions occur in aqueous solutions, the higher acid value of the amorphous resin prompts interaction between the amorphous resin and aqueous solvent, whereas the lower acid value of the crystalline resin induce interaction between crystalline resin particles in an effort to minimize solvent interaction.

The nanoparticles are combined with one or more amorphous resins to form toner particles. The one or more amorphous resins (a second amorphous resin) are selected to be incompatible with the first amorphous resin forming the shell of the nanoparticles so that the nanoparticles can maintain integrity and remain structurally intact.

To obtain desirable toner properties, the second amorphous resin or resins are compatible with the crystalline resin in the core of the nanoparticles.

The toner particles comprising the nanoparticles of interest can comprise a shell, added to the particles as known in the art and taught herein, using resins as known in the art and as taught herein. The toner particle shell can comprise an amorphous resin, a third amorphous resin. A third amorphous resin can be the same as or different from the second amorphous resin. A third amorphous resin is not compatible with the first amorphous resin forming the shell of the nanoparticle. The third amorphous resin is compatible with the crystalline resin comprising the core of the nanoparticle.

To determine whether two resins are compatible or not, the two resins can be melt-mixed, for example, at about 130-150° C. for about 30 minutes. The mixture then is analyzed in a differential scanning calorimeter (DSC) to monitor phase transitions. The melting point or $T_g$ of incompatible resins will remain unchanged following melt mixing. On the other hand, partially or compatible resins will demonstrate, for example, a lower $T_g$, or lower or no melting point. The DSC enables determining the enthalpy of compatibility, which for compatible resins generally is about 0.2 mJ or less, and incompatible resins have values of 4 mJ or greater.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in, for example, U.S. Pat. Nos. 5,290,654 and 5,302,486, the disclosure of each of which hereby is incorporated by reference in entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, loner compositions may be prepared by emulsion aggregation processes, such as a process that includes aggregating a mixture of a nanoparticle comprising a crystalline resin core and a first amorphous resin shell, one or more second amorphous resins, an optional wax, an optional coagulant, and any other desired or required additives, and emulsions including the resins, and colorants as described above, optionally in surfactants as described above, and then coalescing the aggregate mixture. A mixture may be prepared by adding an optional colorant and optionally a wax or other materials, which may also be optionally in a dispersion(s) including a surfactant, to the emulsion, which may be a mixture of two or more emulsions containing the resin(s). For example, emulsion/aggregation/coalescing processes for the preparation of toners are illustrated in the disclosure of the patents and publications referenced herein.

The pH of the resulting mixture may be adjusted by an acid such as, for example, acetic acid, sulfuric acid, hydrochloric acid, citric acid, trifluoroacetic acid, succinic acid, salicylic acid, nitric acid or the like. In embodiments, the pH of the mixture may be adjusted to from about 2 to about 5. In embodiments, the pH is adjusted utilizing an acid in a diluted form of from about 0.5 to about 10 wt % by weight of water, in embodiments, of from about 0.7 to about 5 wt % by weight of water.

Examples of bases used to increase the pH and to ionize the aggregated particles, thereby providing stability and preventing the aggregates from growing in size, may include sodium hydroxide, potassium hydroxide, ammonium hydroxide, cesium hydroxide and the like, among others.

Additionally, in embodiments, the mixture may be homogenized. If the mixture is homogenized, homogenization may be accomplished by mixing at a speed of from about 600 to about 6,000 rpm. Homogenization may be accomplished by any suitable means, including, for example, an IKA ULTRA TURRAX T50 probe homogenizer.

Aggregating Agent

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$-trimethyl ammonium bromides, halide salts of quaternized polyoxyethylalkylamines, dodecylbenzyl triethyl ammonium chloride, combinations thereof, and the like.

Other suitable aggregating agents also include, but are not limited to, tetraalkyl titanates, dialkyltin oxide, tetraalkyltin oxide hydroxide, dialkyltin oxide hydroxide, aluminum alkoxides, alkyl zinc, dialkyl zinc, zinc oxides, stannous oxide, dibutyltin oxide, dibutyltin oxide hydroxide, tetraalkyl tin, combinations thereof, and the like.

Where the aggregating agent is a polyion aggregating agent, the agent may have any desired number of polyion atoms present. For example, in embodiments, suitable polyaluminum compounds have from about 2 to about 13, in embodiments, from about 3 to about 8, aluminum ions present in the compound.

The aggregating agent may be added to the mixture utilized to form a toner in an amount of, for example, from about 0.1 to about 10 wt %, in embodiments, from about 0.2 to about 8 w %, in embodiments, from about 0.5 to about 5 wt %, of the resin in the mixture.

The particles may be permitted to aggregate until a predetermined desired particle size is obtained. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., so long as the temperature is not higher than the melting point of the crystalline resin (the temperature can be higher than the $T_g$ of the amorphous resins) and holding the mixture at that temperature for a time from about 0.5 hr to about 6 hr, in embodiments, from about hour 1 to about 5 hr, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 40° C. to about 90° C., in embodiments, from about 45° C. to about 80° C., which may be above the $T_g$ of the amorphous resin(s) and lower than the melting point of the crystalline resin utilized to form the toner particles.

Once the desired final size of the toner particles is achieved, the pH of the mixture may be adjusted with a base to a value from about 3 to about 10, in embodiments, from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a shell may be applied to the aggregated particles. Any resin described above may be utilized as the shell aside from one which is compatible with the first amorphous resin comprising the shell of the nanoparticle of interest.

In embodiments, an amorphous resin which may be utilized to form a shell includes an amorphous polyamide, optionally in combination with an additional polyester resin latex. Multiple third amorphous resins may thus be utilized in any suitable amounts. In embodiments, a first toner shell amorphous resin may be present in an amount of from about 20% by weight to about 100% by weight of the total shell resin, in embodiments, from about 30% by weight to about 90% by weight of the total shell resin. Thus, in embodiments, a second toner shell amorphous resin may be present in the shell resin in an amount of from about 0.1% by weight to about 80% by weight of the total shell resin, in embodiments, from about 10% by weight to about 70% by weight of the shell resin.

The shell resin may be applied to the aggregated particles by any method within the purview of those skilled in the art. In embodiments, the resins utilized to form the shell may be in an emulsion including any surfactant described above. The emulsion possessing the resins may be combined with the aggregated particles described above so that the shell forms over the aggregated particles.

The formation of the shell over the aggregated particles may occur while heating to a temperature of from about 30° C. to about 80° C., in embodiments, from about 35° C. to about 70° C., so long as the temperature is below the melting point of the crystalline resin, and can be higher than the $T_g$ of the amorphous resin(s). Formation of the shell may take place for a period of time of from about 5 min to about 10 hr, in embodiments, from about 10 min to about 5 hr.

Coalescence

Following aggregation to the desired particle size and application of any optional shell, the particles may then be coalesced to the desired final shape, the coalescence being achieved by, for example, heating the mixture to a temperature from about 45° C. to about 100° C., in embodiments, from about 55° C. to about 99° C., which may be at or above the $T_g$ of the resins utilized to form the toner particles, but is below the crystalline resin melting point and/or reducing the stirring, for example to from about 100 rpm to about 1,000 rpm, in embodiments, from about 200 rpm to about 800 rpm. The fused particles may be measured for shape factor or circularity, such as with a Sysmex FPIA 2100 analyzer, until the desired shape is achieved.

Coalescence may be accomplished over a period from about 0.01 hr to about 3 hr, in embodiments, from about 1 hr to about 2 hr.

After aggregation and/or coalescence, the mixture may be cooled to room temperature (RT), such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze drying.

Additives

In embodiments, the toner particles may also contain other optional additives, as desired or required. For example, the toner may include positive or negative charge control agents, for example, in an amount from about 0.1 to about 10 wt % of the toner, in embodiments, from about 1 to about 3 wt % of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in entirety; organic sulfate and sulfonate compositions, including those disclosed in U.S. Pat. No. 4,338,390, the disclosure of which is hereby incorporated by reference in entirety; cetyl pyridinium tetrafluoroborates; distearyl dimethyl ammonium methyl sulfate; aluminum salts, such as, BONTRON E84™ or E88™ (Orient Chemical Industries, Ltd.); combinations thereof and the like. Such charge control agents may be applied simultaneously with the shell resin described above or after application of the shell resin.

There may also be blended with the toner particles external additive particles after formation including flow aid additives, which additives may be present on the surface of the toner particles. Examples of the additives include metal oxides, such as, titanium oxide, silicon oxide, aluminum oxides, cerium oxides, tin oxide, mixtures thereof, and the like; colloidal and amorphous silicas, such as, AEROSIL®, metal salts and metal salts of fatty acids inclusive of zinc stearate, calcium stearate, long chain alcohols such as UNILIN 700, and mixtures thereof.

In general, silica may be applied to the toner surface for toner flow, triboelectric charge enhancement, admix control, improved development and transfer stability, and higher toner blocking temperature. $TiO_2$ may be applied for improved relative humidity (RH) stability, triboelectric charge control and improved development and transfer stability. Zinc stearate, calcium stearate and/or magnesium stearate may optionally also be used as an external additive for providing lubricating properties, developer conductivity, triboelectric charge enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of the external additives may be present in an amount from about 0.1 wt % to about 5 wt % of the toner, in embodiments, from about 0.25 wt % to about 3 wt % of the toner. In embodiments, the toners may include, for example, from about 0.1 wt % to about 5 wt % titania, from about 0.1 wt % to about 8 wt % silica, from about 0.1 wt % to about 4 wt % zinc stearate.

Suitable additives include those disclosed in U.S. Pat. Nos. 3,590,000 and 6,214,507, the disclosure of each of which hereby is incorporated by reference in entirety. Again, the additives may be applied simultaneously with the shell resin described above or after application of the shell resin.

In embodiments, toners of the present disclosure may be utilized as low melt toners, super low melt toners and ultra low melt toners. In embodiments, the dry toner particles having a core and/or shell may, exclusive of external surface additives, have one or more the following characteristics:

(1) volume average diameter (also referred to as, "volume average particle diameter") of from about 3 to about 25 μm, in embodiments, from about 4 to about 15 μm, in embodiments, from about 5 to about 12 μm;

(2) number average geometric size distribution ($GSD_n$) and/or volume average geometric size distribution ($GSD_v$) can be narrow with a $GSD_n$ of from about 1.15 to about 1.38, in embodiments, less than about 1.31 and a $GSD_v$ in the range of from about 1.20 to about 3.20, in embodiments, from about 1.26 to about 3.11, where volume average particle diameter, $D_{50v}$, $GSD_v$ and $GSD_n$ may be measured, for example, by a Beckman Coulter Multisizer 3;

(3) shape factor of from about 105 to about 170, in embodiments, from about 110 to about 160, SF1*a, determine, for example, by scanning electron microscopy (SEM) and image analysis, where the average particle shape can be quantified by employing the formula: $SF1*a=100\pi d^2/(4A)$, where A is the area of the particle and d is its major axis, a perfectly circular or spherical particle has a shape factor of exactly 100 and the shape factor, SF1*a, increases as the shape becomes more irregular or elongated with a higher surface area; and (4) circularity of from about 0.92 to about 0.99, in embodiments, from about 0.94 to about 0.975, measured, for example, with an FPIA-2100 manufactured by Sysmex.

The characteristics of the toner particles may be determined by any suitable technique and apparatus and are not limited to the instruments and techniques indicated herein.

In embodiments, the toner particles may have an $M_w$ from about 17,000 to about 60,000 daltons, an $M_n$ of from about 9,000 to about 18,000 daltons and an MWD (equivalent to PDI) of from about 2.1 to about 10.

Further, the toners, if desired, may have a specified relationship between the molecular weight of the latex resin and the molecular weight of the toner particles obtained following the emulsion aggregation procedure. As understood in the art, the resin undergoes crosslinking during processing, and the extent of crosslinking may be controlled during the process. The relationship may best be seen with respect to the molecular peak values (Mp) for the resin which represents the highest peak of the MW. In the present disclosure, the resin may have an Mp of from about 22,000 to about 30,000 daltons, in embodiments, from about 22,500 to about 29,000 daltons. The toner particles prepared from the resin also exhibit a high molecular peak, for example, in embodiments, of from about 23,000 to about 32,000, in embodiments, from about 23,500 to about 31,500 daltons, indicating that the molecular peak is driven by the properties of the resin rather than another component, such as, the wax.

Toners produced in accordance with the present disclosure may possess excellent charging characteristics when exposed to extreme RH conditions. The low humidity zone (C zone) may be about 12° C./15% RH, while the high humidity zone (A zone) may be about 28° C./85% RH. Toners of the present disclosure may possess a parent toner charge per mass ratio (q/m) of from about −2 μC/g to about −100 μC/g, in embodiments, from about −5 μC/g to about −90 μC/g, and a final toner charging after surface additive blending of from −8 μC/g to about −85 μC/g, in embodiments, from about −15 μC/g to about −80 μC/g.

Developer

The toner particles may be formulated into a developer composition. For example, the toner particles may be mixed with carrier particles. The carrier particles may be mixed with the toner particles in various combinations. The toner concentration in the developer may be from about 1% to about 25% by weight of the developer, in embodiments, from about 2% to about 15% by weight of the total weight of the developer (although values outside of those ranges may be used). However, different toner and carrier percentages may be used to achieve a developer composition with desired characteristics.

Carriers

Illustrative examples of carrier particles that may be selected for mixing with the toner composition prepared in accordance with the present disclosure include those particles that are capable of triboelectrically obtaining a charge of opposite polarity to that of the toner particles. Accordingly, in embodiments, the carrier particles may be selected so as to be of a negative polarity so toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites and the like. Other carriers include those disclosed in U.S. Pat. Nos. 3,847,604, 4,937,166, and 4,935,326.

The selected carrier particles may be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings, and the like. For example, coatings containing polyvinylidenefluoride, available, for example, as KYNAR 301F™, and/or polymethylmethacrylate, for example, having a weight average molecular weight of about 300,000 to about 350,000, such as commercially available from Soken, may be used. In embodiments, polyvinylidenefluoride and polymethylmethacrylate (PMMA) may be mixed in proportions of from about 30 wt % to about 70 wt %, in embodiments, from about 40 wt % to about 60 wt % (although values outside of those ranges may be used). The coating may have a coating weight of, for example, from about 0.1 wt % to about 5% by weight of the carrier, in embodiments, from about 0.5 wt % to about 2% by weight of the carrier (although values outside of those ranges may be obtained).

In embodiments, PMMA may optionally be copolymerized with any desired comonomer, so long as the resulting copolymer retains a suitable particle size. Suitable comonomers may include monoalkyl or dialkyl amines, such as, a dimethylaminoethyl methacrylate, diethylaminoethyl methacrylate, diisopropylaminoethyl methacrylate, t-butylaminoethyl methacrylate and the like. The carrier particles may be prepared by mixing the carrier core with a polymer in an amount from about 0.05 wt % to about 10 wt %, in embodiments, from about 0.01 wt % to about 3 wt %, based on the weight of the coated carrier particles (although values outside of those ranges may be used), until adherence thereof to the carrier core by, for example, mechanical impaction and/or electrostatic attraction, is obtained.

Various effective suitable means may be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof and the like. The mixture of carrier core particles and polymer may then be heated to enable the polymer to melt and to fuse to the carrier core particles. The coated carrier particles may then be cooled and thereafter classified to a desired particle size.

In embodiments, suitable carriers may include a steel core, for example of from about 25 to about 100 μm in size, in embodiments, from about 50 to about 75 in size (although sizes outside of those ranges may be used), coated with about 0.5% to about 10% by weight, in embodiments, from about 0.7% to about 5% by weight (although amounts outside of those ranges may be obtained), of a conductive polymer mixture including, for example, methylacrylate and carbon black using the process described in U.S. Pat. Nos. 5,236,629 and 5,330,874.

The carrier particles may be mixed with the toner particles in various suitable combinations. The concentrations are may be from about 1% to about 20% by weight of the toner composition (although concentrations outside of that range may be used). Different toner and carrier percentages may be used to achieve a developer composition with desired characteristics.

Imaging

Toners of the present disclosure may be utilized in electrophotographic imaging methods, including those disclosed in, for example, U.S. Pat. No. 4,295,990, the disclosure of which is hereby incorporated by reference in entirety. In embodiments, any known type of image development system may be used in an image developing device, including, for example, magnetic brush development, jumping single-component development, hybrid scavengeless development (HSD) and the like. Those and similar development systems are within the purview of those skilled in the art.

Imaging processes include, for example, preparing an image with a xerographic device including a charging component, an imaging component, a photoconductive component, a developing component, a transfer component and a fusing component. In embodiments, the development component may include a developer prepared by mixing a carrier with a toner composition described herein. The xerographic device may include a high speed printer, a black and white high speed printer, a color printer and the like.

Once the image is formed with toners/developers via a suitable image development method, such as, any one of the aforementioned methods, the image may then be transferred to an image receiving medium, such as, paper and the like. In embodiments, the toners may be used in developing an image in an image-developing device utilizing a fuser roll member. Fuser roll members are contact fusing devices that are within the purview of those skilled in the art, in which heat and/or pressure from the roll may be used to fuse the toner to the image-receiving medium. In embodiments, the fuser member may be heated to a temperature above the fusing temperature of the toner, for example to temperatures of from about 70° C. to about 160° C., in embodiments, from about 80° C. to about 150° C., in embodiments, from about 90° C. to about 140° C. (although temperatures outside of those ranges may be used), after or during melting onto the image receiving substrate.

Image performance can be determined by producing unfused test images with a commercially available copier/printer and paper. Images are removed from the device before the document passes through the fuser. The unfused test samples are then fused using a known fuser, such as, a Xerox Corporation iGen3® fuser, using a selected process condition, such as, about 100 prints per minute. Fuser roll temperature is varied so that gloss and crease area can be determined as a function of the fuser roll temperature. Print gloss can be measured using, for example, a BYK Gardner 75° gloss meter. How well toner adheres to the paper can be determined by the crease fix MFT. The fused image is folded and about an 860 g weight of toner is rolled across the fold after which the page is unfolded and wiped to remove fractured toner from the sheet, which then is scanned with a flatbed scanner and the area of removed toner is determined by image analysis software, such as, the National Instruments IMAQ.

The following Examples are being submitted to illustrate embodiments of the present disclosure. The Examples are intended to be illustrative only and are not intended to limit the scope of the present disclosure. Also, parts and percentages are by weight unless otherwise indicated.

EXAMPLES

Comparative Example 1

Synthesis of a Crystalline Resin with High Acid Value

A 1 liter Parr reactor equipped with a mechanical stirrer (Twin T-4 type) and distillation apparatus was charged with 355.5 g of 1,12-dodecanedioic acid, 240 g of nonanediol, 15.6 g of neopentyl glycol and 0.5 g of stannoic acid. The mixture was heated to 165° C. and stirred at 100 rpm. The mixture was then heated to 205° C. over a 5 hr period, followed by reducing the pressure to 0.1 mm-Hg over a one hr period. A sample was retrieved and tested until a viscosity of 4650 centipoise (at 100° C.) was achieved (over 3-4 hr). The acid value (AV) of the crystalline polyester was 10.4 mg of KOH/g of resin.

To 100 g of the above crystalline resin were added 100 g of methyl ethyl ketone and 5 g of isopropanol. The mixture was stirred at 45° C. to dissolve the resin and then 10 g of an aqueous solution of ammonium hydroxide (1 N) were added dropwise. The mixture was stirred at about 200 rpm and 120 mL of water then were added dropwise. The temperature was increased to 80° C. at about 1° C. per min to distill the organic solvents from the mixture. Stirring of said mixture was continued at 80° C. for about 180 min followed by cooling at about 2° C. per min to RT. The product was screened through a 25 μm sieve. The resulting resin emulsion was comprised of about 41% by weight solids in water, with an average particle size of 180 nm.

Example 1

Synthesis of a Crystalline Resin with Low Acid Value

A 1 L Parr reactor equipped with a mechanical stirrer (Twin T-4 type) and distillation apparatus was charged with 345.5 g of 1,12-dodecanedioic acid, 240 g of nonanediol, 15.6 g of neopentyl glycol and 0.5 g of stannoic acid. The mixture was heated to 165° C. and stirred at 100 rpm. The mixture was then heated to 205° C. over a 5 hr period, followed by reducing the pressure to 0.1 mm-Hg over a one hr period. A sample was retrieved and tested until a viscosity of 4600 centipoise (at 100° C.) was achieved (over 3-4 hr). The acid value (AV) of the crystalline polyester (CPE) resin was 0.79 mg of KOH/g of resin.

Comparative Example 2

Preparation of Toner Containing 6.8% wt of CPE Resin of Comparative Example 1 with a Low and High MW Amorphous Resin, but No Encapsulated Nanoparticles Two amorphous resins derived from propoxylated bisphenol A, fumaric acid, terephthalic acid and dodecenyl succinic acid were obtained from ICAO Corporation as XH-1 and XL-1. Both resins were emulsified into resin particles utilizing the emulsification procedure of Example 1. Into a 2 L glass reactor equipped with an overhead mixer was added 63.57 g low MW amorphous resin (XL-1) emulsion ($M_w$=19,400, $T_g$ onset=60° C., 35.6 wt %), 65.22 g high MW amorphous resin (XH-1) emulsion ($M_w$=86,000, $T_g$ onset=56° C., 34.7 wt %), 14.9 g of the crystalline resin emulsion of Comparative Example 1, 26.06 g IGI wax dispersion (30.98 wt %) and 30.48 g cyan pigment PB15:3 (17.21 wt %). Separately, 1.57 g $Al_2(SO_4)_3$ (27.85 wt %) were added as flocculent under homogenization. The mixture was heated to 43.4° C. to aggregate the particles while stirring at 300 rpm. The particle size was monitored with a Coulter Counter until the core particles reached a volume average particle size of 5.03 μm with a $GSD_v$ of 1.21. Then, a mixture of 35.10 g and 36.01 g of above mentioned low and high MW resin emulsions were added as shell material, resulting in a core-shell particles with an average particle size of 5.83 μm, $GSD_v$ of 1.18. Thereafter, the pH of the reaction slurry was then increased to 8 using 4 wt % NaOH solution followed by 3.37 g EDTA (39 wt %) to freeze toner growth. After freezing, the reaction mixture was heated to 85° C., and pH was reduced to 6.9 using pH 5.7 acetic acid/sodium acetate (HAc/NaAc) buffer solution for coalescence.

The toner was quenched after coalescence, resulting in a final particle size of 6.12 μm, $GSD_v$ of 1.23 and circularity of 0.962. The toner slurry was then cooled to RT, separated by sieving (25 μm) filtration, followed by washing and freeze dried.

Comparative Example 3

Preparation of Toner Containing 10.2% wt of CPE Resin of Comparative Example 1 with a Low and High MW Amorphous Resin, and No Encapsulated Nanoparticles XH-1 and XL-1 of Comparative Example 2 were emulsified into resin particles utilizing the emulsification procedure of Example 1. Into a 2 L glass reactor equipped with an overhead mixer was added 63.57 g XL-1 emulsion (35.6 wt %), 65.22 g XH-1 emulsion (34.7 wt %), 22.5 g of the crystalline resin emulsion of Comparative Example 1, 26.06 g IGI wax dispersion (30.98 wt %) and 30.48 g cyan pigment PB15:3 (17.21 wt %). Separately, 1.57 g $Al_2(SO_4)_3$ (27.85 wt %) were added as flocculent under homogenization. The mixture was heated to 43.4° C. to aggregate the particles while stirring at 300 rpm. The particle size was monitored with a Coulter Counter until the core particles reached a volume average particle size of 5.13 μm with a $GSD_v$ of 1.22. Then, a mixture of 35.10 g and 36.01 g of above mentioned low and high MW resin emulsions were added as shell material, resulting in a core-shell particles with an average particle size of 5.81 μm, $GSD_v$ of 1.19. Thereafter, the pH of the reaction slurry was then increased to 8 using 4 wt % NaOH solution followed by 3.37 g EDTA (39 wt %) to freeze toner growth. After freezing, the reaction mixture was heated to 85° C., and pH was reduced to 6.9 using pH 5.7 acetic acid/sodium acetate (HAc/NaAc) buffer solution for coalescence.

Comparative Example 4

Preparation of Toner Containing 13.6% wt of CPE Resin of Comparative Example 1 with a Low and High MW Amorphous Resin, and No Encapsulated Nanoparticles XH-1 and XL-1 were emulsified into resin particles utilizing the emulsification procedure of Example 1. Into a 2 L glass reactor equipped with an overhead mixer was added 63.57 g XL-1 emulsion (35.6 wt %), 65.22 g XH-1 emulsion (34.7 wt %), 30 g of the crystalline resin emulsion of Comparative Example 1, 26.06 g IGI wax dispersion (30.98 wt %) and 30.48 g cyan pigment PB15:3 (17.21 wt %). Separately, 1.57 g $Al_2(SO_4)_3$ (27.85 wt %) were added as flocculent under homogenization. The mixture was heated to 43.4° C. to aggregate the particles while stirring at 300 rpm. The particle size was monitored with a Coulter Counter until the core particles reached a volume average particle size of 5.23 μm with a $GSD_v$ of 1.21. Then, a mixture of 35.10 g and 36.01 g of above mentioned low and high MW resin emulsions were added as shell material, resulting in a core-shell particles with an average particle size of 5.93 $GSD_v$ of 1.19. Thereafter, the pH of the reaction slurry was then increased to 8 using 4 wt % NaOH solution followed by 3.37 g EDTA (39 wt %) to freeze toner growth. After freezing, the reaction mixture was heated to 85° C., and pH was reduced to 6.9 using pH 5.7 acetic acid/sodium acetate (HAc/NaAc) buffer solution for coalescence.

Example 2

Preparation of Encapsulated Nanoparticle Emulsion, with the Core Comprising the CPE Resin of Example 1, with an Amorphous Resin as Shell Compatibility studies of various amorphous resins determined that XP777, a poly-(propoxylated bisphenol A-fumarate) resin obtained from Reichhold Chemicals, was suitable as the first amorphous resin for the nanoparticle shell, and the low and high molecular weight amorphous resins described above (XL-1 and XH-1) were suitable candidates for the second and third amorphous resins because the resins were not compatible with XP777.

Forty grams of CPE resin of Example 1, and 10 g of XP777 resin (acid value 17.8) were measured into a 2 L beaker containing about 500 g of ethyl acetate. The mixture was stirred at about 300 rpm at RT to dissolve the resin. About 0.22 g of sodium bicarbonate and 3.19 g of DOWFAX (47 wt %) were measured into a 2 L Pyrex glass flask reactor containing about 300 g of DIW. Homogenization was commenced with an IKA ULTRA TURRAX T50 homogenizer at 4,000 rpm. The resin solution was then slowly poured into the water solution as the mixture continued to be homogenized, the homogenizer speed was increased to 8,000 rpm and homogenization was carried out at those conditions for about 30 min. On completion of homogenization, the glass flask reactor was placed in a heating mantle and connected to a distillation device. The mixture was stirred at about 200 rpm and the temperature of said mixture was increased to 80° C. at about 1° C. per min to distill the ethyl acetate from the mixture. Stirring of the said mixture was continued at 80° C. for about 180 min followed by cooling at about 2° C. per min to RT. The product was screened through a 25 μm sieve. The resulting nanoparticle emulsion was comprised of about 13.65% by weight solids in water, with an average nanoparticle size of 170.6 nm.

Example 3

Preparation of Toner with 6.9 wt % CPE with the Encapsulated Nanoparticle Emulsion of Example 2

Into a 2 liter glass reactor equipped with an overhead mixer were added 81.35 g XL-1 (35.6 wt %), 89.45 g XH-1 (34.7 wt %), 76.80 g of the above mentioned encapsulated crystalline resin emulsion (13.65 wt %), 35.73 g IGI wax dispersion (30.98 wt %) and 41.80 g cyan pigment PB15:3 (17.21 wt %). Separately, 2.15 g $Al_2(SO_4)_3$ (27.85 wt %) were added as flocculent under homogenization. The mixture was heated to 51.5° C. to aggregate the particles while stirring at 300 rpm. The particle size was monitored with a Coulter Counter until the core particles reached a volume average particle size of 4.94 μm with a $GSD_v$ of 1.22. Then a mixture of 48.14 g and 49.38 g of the above mentioned low and high MW resin emulsions were added as shell material, resulting in a core-shell structured particles with an average particle size of 6.02 μm, $GSD_v$ of 1.19. Thereafter, the pH of the reaction slurry was then increased to 8.1 using 4 wt % NaOH solution followed by 4.62 g EDTA (39 wt %) to freeze toner growth. After freezing, the reaction mixture was heated to 85° C., and pH was reduced to 7.06 using pH 5.7 acetic acid/sodium acetate (HAc/NaAc) buffer solution for coalescence.

The toner was quenched after coalescence, resulting in a final particle size of 6.21 μm, $GSD_v$ of 1.21 and circularity of 0.975. The toner slurry was then cooled to RT, separated by sieving (25 μm) filtration, followed by washing and freeze dried.

Example 4

Preparation of Toner with 13.6 wt % CPE with the Encapsulated Nanoparticle Emulsion of Example 2

Into a 2 L glass reactor equipped with an overhead mixer were added 75.52 g XL-1 emulsion (35.6 wt %), 89.45 g XH-1 emulsion (34.7 wt %), 153.60 g of the above mentioned encapsulated crystalline resin emulsion (13.65 wt %), 35.73 g IGI wax dispersion (30.98 wt %) and 41.80 g cyan pigment PB15:3 (17.21 wt %). Separately, 2.15 g $Al_2(SO_4)_3$ (27.85 wt %) were added as flocculent under homogenization. The mixture was heated to 47.1° C. to aggregate the particles while stirring at 300 rpm. The particle size was monitored with a Coulter Counter until the core particles reached a volume average particle size of 4.73 μm with a $GSD_v$ of 1.20. Then, a mixture of 48.14 g and 49.38 g of the above mentioned low and high MW resin emulsions were added as shell material, resulting in core-shell particles with an average particle size of 6.02 μm and $GSD_v$ of 1.19. Thereafter, the pH of the reaction slurry was then increased to 8.2 using 4 wt % NaOH solution followed by 4.62 g EDTA (39 wt %) to freeze toner growth. After freezing, the reaction mixture was heated to 85° C., and pH was reduced to 6.84 using pH 5.7 acetic acid/sodium acetate (HAc/NaAc) buffer solution for coalescence. The toner was quenched after coalescence, resulting in a final particle size of 6.21 μm, $GSD_v$ of 1.21 and circularity of 0.960. The toner slurry was then cooled to RT, separated by sieving (25 μm) filtration, followed by washing and freeze dried.

Results

Three comparative control toners were made comprised of the non-encapsulated crystalline resin at varying amounts of 6.8%, 10.2% and 13.6% of the total weight. Two experimental toners were made where the low acid value crystalline resin was encapsulated with an amorphous XP777 resin, and with corresponding CPE loading of 6.8% and 13.6%. Otherwise, the same ratio of ingredients was used in an emulsion aggregation process.

All toners were blended with surface additives comprised of 1.28 parts per hundred (ppH) of RY50L silica available from Degussa Corp., 0.86 ppH of RX50 silica obtained from Degussa, 0.88 ppH of STT100H titania obtained from Titan Chemicals Corp., 1.73 ppH of X24 available from Shin-Etsu Chemicals, 0.28 ppH of E10 cerium dioxide available from Mitsui Mining & Smelting Company, 0.18 ppH of ZnFP (zinc stearate) available from NOF Corp. and 0.5 ppH of MP116F (PMMA) available from Soken Chemicals.

Charging results are summarized in Table 1, and indicated that similar charge was obtained for all samples. Maintenance of charge was enhanced for the encapsulated crystalline resin toners, particularly at higher crystalline resin content.

TABLE 1

Charging Data.

| Examples | Description | A-zone 60 Q/d | A-zone 60 Q/m | A-zone 2 Q/m | C-Zone 60 Q/d | C-Zone 60 Q/m | Charge Maintenance 24 hours | Charge Maintenance 7 days |
|---|---|---|---|---|---|---|---|---|
| Comparative Example 2 | Non-encapsulated 6.9% CPE | 7.2 | 42 | 57 | 17.5 | 79 | 83 | 68 |
| Comparative Example 3 | Non-encapsulated 10.2% CPE | 7.6 | 39 | 53 | 16.5 | 70 | 76 | 50 |
| Comparative Example 4 | Non-encapsulated 13.6% CPE | 7.8 | 37 | 43 | 19.6 | 70 | 78 | 53 |
| Example 3 | Encapsulated 6.9% CPE | 6.6 | 35 | 46 | 16 | 74 | 86 | 62 |
| Example 4 | Encapsulated 13.6% CPE | 7.5 | 33 | 48 | 18 | 67 | 85 | 60 |

Fusing results on Xerox paper are summarized in Table 2 and indicated that increasing the amounts of encapsulated CPE resin in the toner resulted in improved crease fusing. In Table 2, Cold Offset is the temperature at which the image lifts onto the fuser roll without being fixed on paper, the minimum fix temperature (MFT) is for a crease area of 80. Fusing latitude is the difference between hot offset temperature and MFT. Gloss MFT is the gloss at the fix temperature. Hot offset is the temperature at which the toner lifts off the paper and sticks to the fuser roll.

TABLE 2

Fusing Properties.

| Fusing Characteristics | Comparative Example 2 (° C.) | Comparative Example 3 (° C.) | Comparative Example 4 (° C.) | Example 3 (° C.) | Example 4 (° C.) |
|---|---|---|---|---|---|
| Cold offset | 125 | 112 | 115 | 119 | 112 |
| Gloss MFT | 27.8 | 26.6 | 30.6 | 27.8 | 36.8 |
| MFT | 117 | 114 | 112 | 122 | 111 |
| Hot-Offset | 186 | 186 | 176 | 190 | 185 |
| Fusing Latitude | 69 | 72 | 64 | 68 | 74 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

All references cited herein are herein incorporated by reference in entirety.

What is claimed is:

1. An ultra-low melt toner particle comprising:

a nanoparticle comprising a core and a shell, wherein the core comprises a crystalline resin and the shell comprises a first amorphous resin, wherein the crystalline resin has an acid value lower than 1 meg KOH/g and the first amorphous resin has an acid value greater than 10 meg KOH/g;

at least one second amorphous resin; and optionally, a pigment, a wax or both.

2. The toner particle of claim 1, wherein said toner particle comprises a shell.

3. The toner particle of claim 2, wherein said toner particle shell comprises a third amorphous resin.

4. The toner particle of claim 3, wherein the second and third amorphous resins are different and are incompatible with the first amorphous resin.

5. The toner particle of claim 3, wherein the second and third amorphous resins are compatible with the crystalline resin.

6. The toner particle of claim 1, wherein the first amorphous resin of the nanoparticle comprises an acid value of greater than about 15 meg KOH/g.

7. The toner particle of claim 4, wherein the incompatible resins comprise an enthalpy of crystallization of greater than about 4.0 mJ.

8. The toner particle of claim 5, wherein the compatible resins comprise an enthalpy of crystallization of less than about 0.2 mJ.

9. The toner particle of claim 1, wherein the crystalline resin comprises from about 7% to about 40% by weight of the toner particle.

10. The toner particle of claim wherein the nanoparticle has a size of between about 50 to about 250 nm.

11. The toner article of claim 1, comprising a pigment.

12. The toner particle of claim 1, comprising an emulsion aggregation toner particle.

13. The toner particle of claim 1, comprising a high molecular weight amorphous resin and a low molecular weight amorphous resin.

14. The toner particle of claim 13, wherein said first amorphous resin comprises said high molecular weight amorphous resin.

15. The toner particle of claim 13, wherein said first amorphous resin comprises said low molecular weight amorphous resin.

16. The toner particle of claim 1, comprising a minimum fixing temperature of from about 100° C. to about 130° C.

17. The toner particle of claim 1, comprising a fusing latitude of at least about 60° C.

18. The toner particle of claim 1, wherein said first amorphous resin comprises a poly-(propoxylated bisphenol A-fumarate) resin.

19. The toner particle of claim 1, further comprising and additional second amorphous resin.

* * * * *